US006206747B1

(12) United States Patent
Skwarek

(10) Patent No.: US 6,206,747 B1
(45) Date of Patent: Mar. 27, 2001

(54) WIND INDICATOR TOY

(75) Inventor: Mark Leslie Skwarek, East Haddam, CT (US)

(73) Assignee: Go Fly A Kite, East Haddam, CT (US)

( * ) Notice: Subject to any disclaimer, the term of this patent is extended or adjusted under 35 U.S.C. 154(b) by 0 days.

(21) Appl. No.: 09/419,370

(22) Filed: Sep. 27, 1999

(51) Int. Cl.[7] ..... A63H 33/40
(52) U.S. Cl. ..... 446/217; 446/218
(58) Field of Search ..... 446/201, 217, 446/218, 126, 199, 176

(56) References Cited

U.S. PATENT DOCUMENTS

| | | | | |
|---|---|---|---|---|
| 571,449 | * | 11/1896 | Laube | 446/176 |
| 1,337,483 | * | 4/1920 | Romaniello | 446/176 |
| 1,421,161 | * | 6/1922 | Browne et al. . | |
| 1,464,993 | * | 8/1923 | Leszczynski | 446/176 |
| 1,467,336 | * | 9/1923 | Rumfelt | 446/176 |
| 1,583,881 | * | 5/1926 | Heberling . | |
| 1,681,415 | * | 8/1928 | Lee | 446/176 |
| 2,170,771 | * | 8/1939 | Benjamin | 446/126 |
| 2,313,357 | * | 3/1943 | Pajeau | 446/126 |
| 2,638,705 | * | 5/1953 | Petrasy | 446/176 |
| 3,220,253 | * | 11/1965 | Parker | 446/176 |
| 5,241,777 | * | 9/1993 | Looker et al. . | |
| 5,368,515 | * | 11/1994 | Mast | 446/217 |
| 5,928,051 | * | 7/1999 | Krog | 446/126 |
| 5,971,828 | * | 10/1999 | Lin | 446/217 |

* cited by examiner

*Primary Examiner*—Jacob K. Ackun
*Assistant Examiner*—Bena B. Miller
(74) *Attorney, Agent, or Firm*—Jonathan E. Grant; Grant Patent Services

(57) ABSTRACT

The invention discloses a colorful wind indicator toy, suitable for use by children, which will both educate and entertain them. The wind indicator toy comprises a tail section for catching the wind, a front section for indicating the direction of the wind, a tail mounting section for mounting the tail section, a joinder for joining the tail mounting section with the front section, and a pole upon which the assembly rotates.

13 Claims, 3 Drawing Sheets

WIND INDICATOR TOY

BACKGROUND OF THE INVENTION

1. Field of the Invention

This invention discloses a colorful wind indicator toy, suitable for use by children, which will both educate and entertain them.

2. Description of the Prior Art

In the past, there have been a number of inventions relating to amusement devices based on wind power.

U.S. Pat. No. 1,583,881 (J. Heberling) discloses a pinwheel having a relatively rigid metal center, flexible non-metallic blades fastened to the center, with each of the blades being individual and being cut as a blank separate from the remaining blades, of portion of each of the blades being curved over the metal center.

U.S. Pat. No. 1,669,748 (G. G. Greger) discloses a pin wheel having a wheel made from a blank provided with curved slits to form a plurality of tapering blades. The wheel has its central portion mounted on the pin with the blade tips brought together on the pin in spaced relation to the central portion of the wheel blank. A baffle on the pin rests against the edges of the gathered tip portions.

There have also been a number of patents

U.S. Pat. No. 5,811,673 (Kwok et al.) discloses a wind direction indicator having a rotatable wind vane and a support for connection to the mast of a yacht. The vane is connected to the support by means of a gimbal mechanism and a stabilizing weight is connected to the gimbal mechanism diametrically opposite the vane.

U. S. Pat. No. 4,227,406 (Coffey) discloses a wind direction device for attachment to a boat shroud for indicating the direction of the wind relative to the direction of travel of the boat. The device includes several wraps of adhesive tape around a boat shroud to form an upwardly facing shoulder at a midpoint of the shroud of the boat, a bearing resting on the shoulder and having a hold through which is received the shroud, which bearing as a slit in one side and is and is sufficiently flexible and resilient so that the size of the slit can be varied to position the bearing around the shroud and retain the bearing on the shroud.

U.S. Pat. No. 5,127,358 (Galloway et al.) discloses an apparent wind direction indicator having a masthead device for sailboats. These marks can be adjusted with greater compass accuracy to allow several setting in each quadrant creating a series of reference points enabling one to more accurately determine the apparent wind angle from a center point and thus optimize sail trim, heading and boat speed.

There has been no device which both acts as an apparent wind direction indicator and which provides the amusement of a pinwheel.

SUMMARY OF THE INVENTION

The proposed invention discloses a colorful wind indicator toy, suitable for use by children, which will both educate and entertain them. The wind indicator toy comprises a tail section for catching the wind, a front section for indicating the direction of the wind, a tail mounting section for mounting the tail section, a joinder for joining the tail mounting section with the front section, and a pole upon which the assembly rotates.

In one embodiment of the invention, the device front of the device is shaped like an animal. Both sections are brightly colored. In another embodiment of the invention, the back section may be shaped like a tail or a fin.

DETAILED DESCRIPTION OF THE INVENTION

Figure 1:
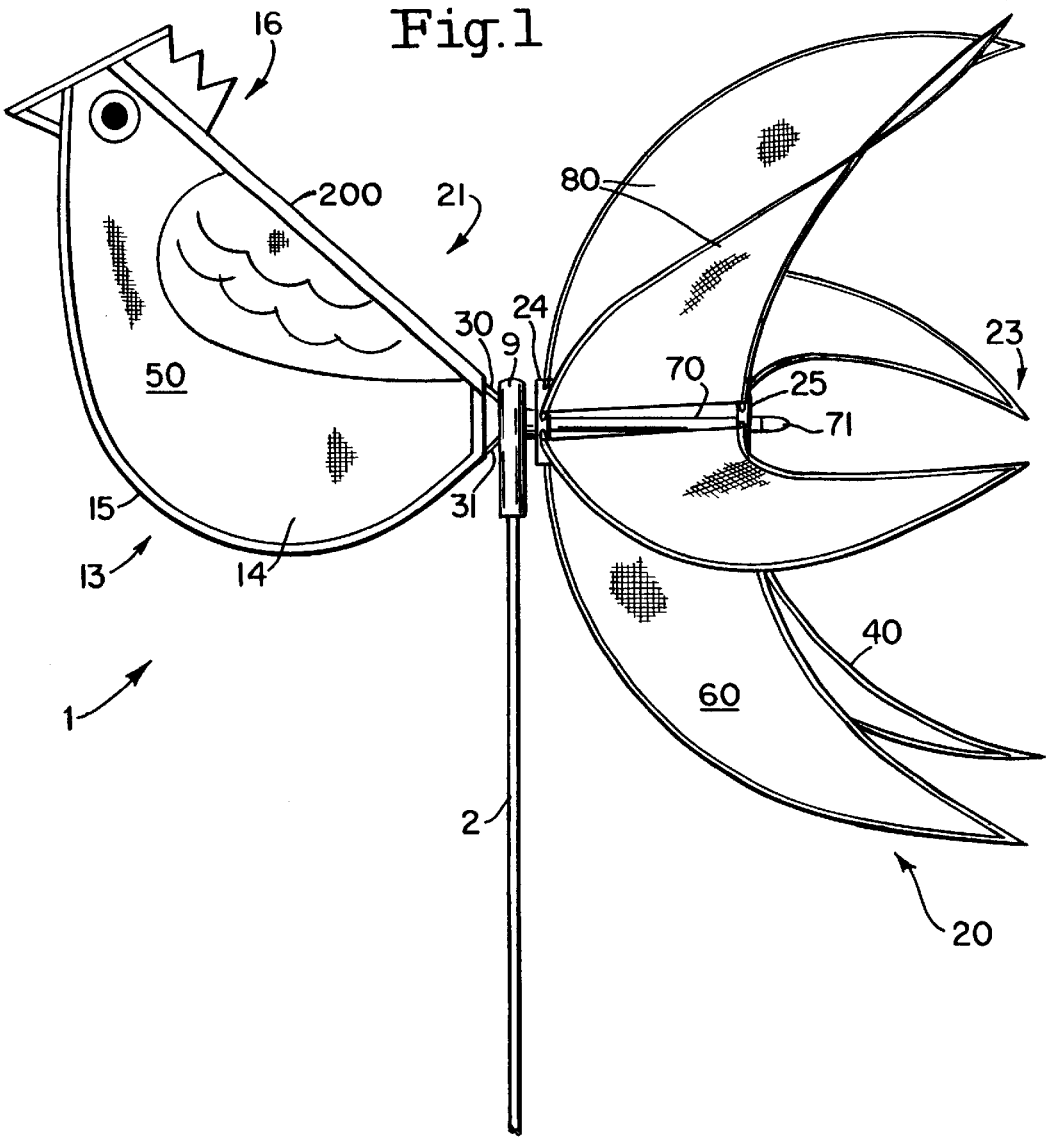
FIG. 1 is a side view of one embodiment of the invention.
Figure 6:
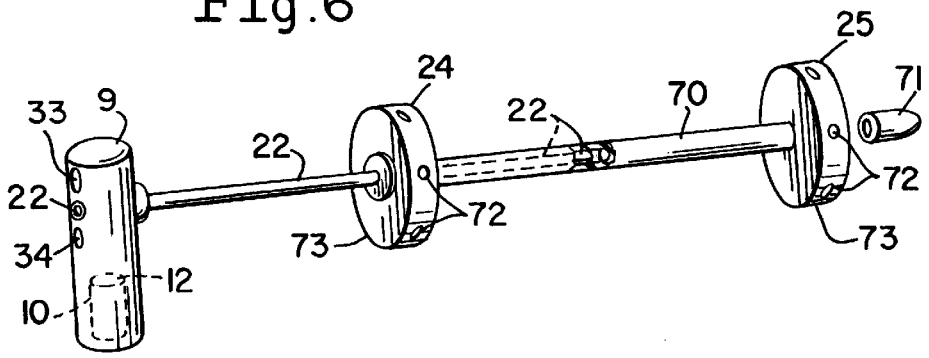
FIG. 6 is a perspective view of the support for the back section of the invention.
Figure 2:
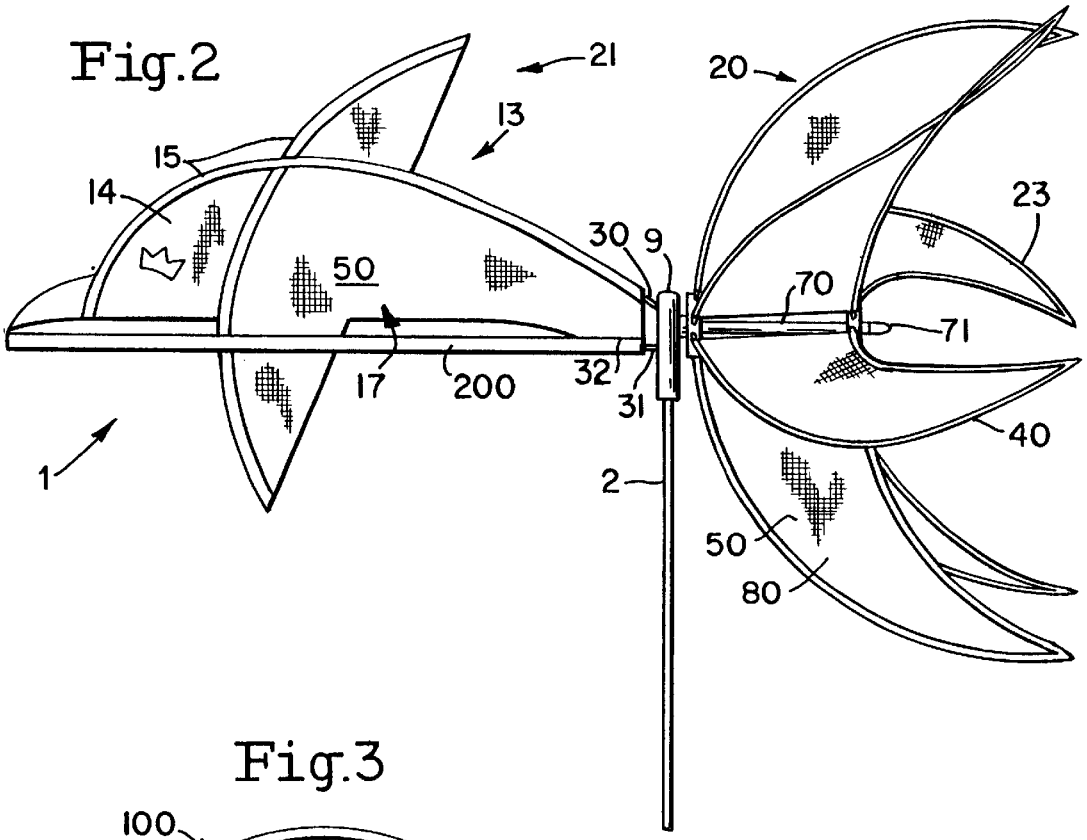
FIG. 2 is a side view of another embodiment of the invention.
Figure 3:
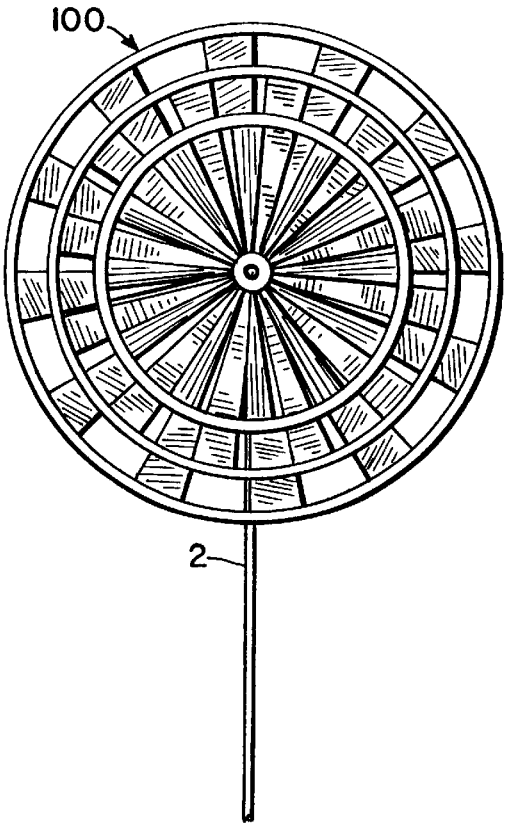
FIG. 3 is a side view of another embodiment of the invention.
Figure 4:
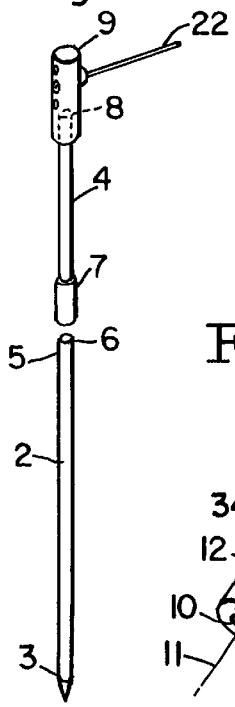
FIG. 4 is a perspective view of the ground stake.
Figure 5:
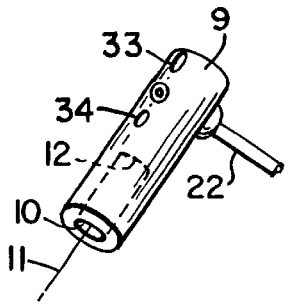
FIG. 5 is a perspective view of the hollow doll.
Figure 7:
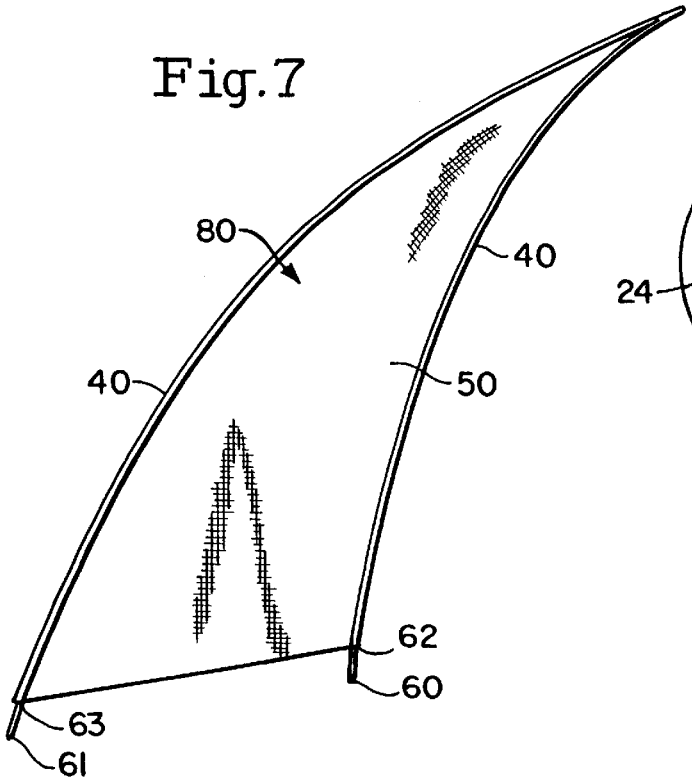
FIG. 7 is a side view of the tail.
Figure 8:
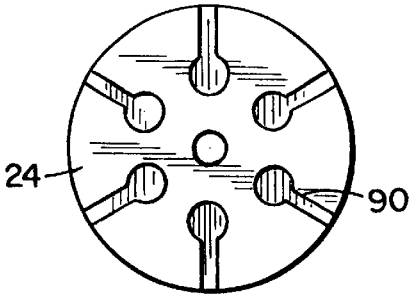
FIG. 8 is a frontal view of one embodiment of the disk type structure.
Figure 9:
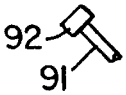
FIG. 9 is a perspective view of one embodiment of the projection.
Figure 10:
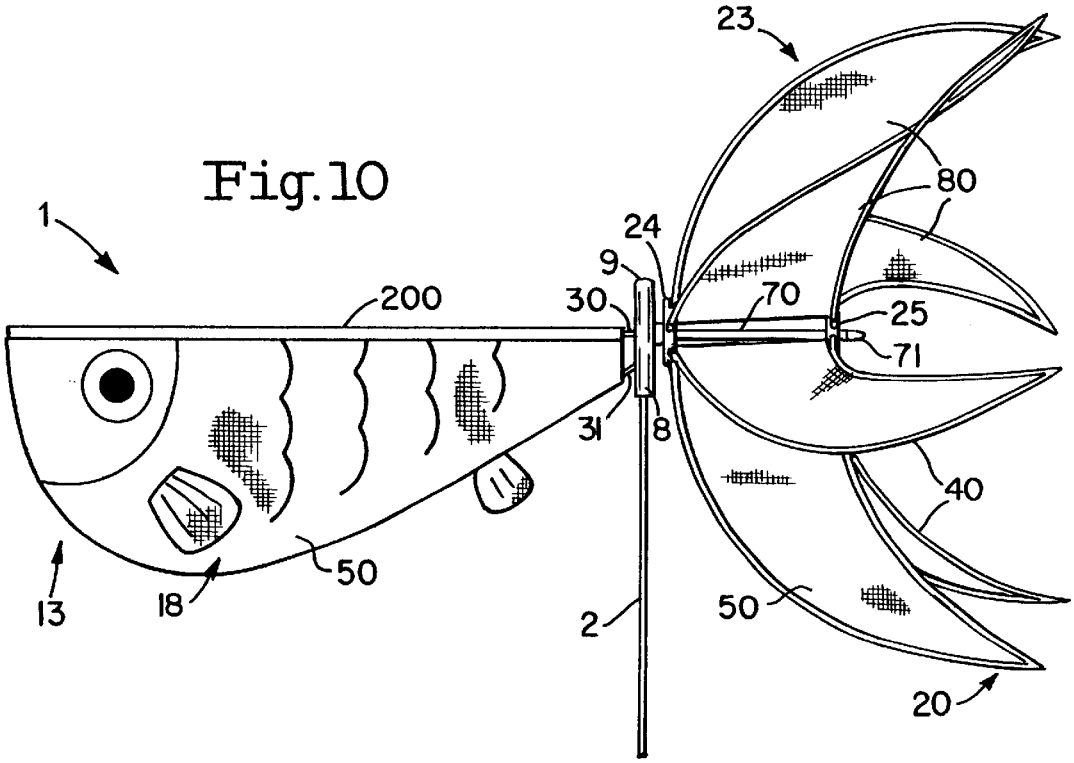
FIG. 10 is a side view of another embodiment of the invention.

The wind indicator toy 1 has a ground stake 2, preferably having a pointed end 3, which can be pushed into the ground. An extension piece 4 can be attached to the top S of the ground stake 2 with the ground stake 2 and the extension piece 4 preferably having a male 6 and female 7 connector. At the top 8 of the extension piece 4 or at the top of the ground stake 2, there should be a pivot doll 9. The pivot doll 9 has a hole 10 drilled through its center 11 so that the pivot doll 9 can rotate atop the top of the stake 2 or the extension piece 4. The hole is not drilled completely through the pivot doll 9; the end 12 of the pivot doll 9 prevents the doll from slipping down the stake 2.

Attached to the pivot doll 9 is a front section 13 which holds a directional indicator 14. The directional indicator 14 is a flat piece of material 50, tightly stretched and supported by a frame 15. The flat piece of material can be in the shape of a bird 16 , a dolphin 17 , a fish 18 , or any other identifiable form. The material 50 used can be nylon, silk, plastic, paper, cloth, or any other type of material which is flexible and durable. It is preferred that the material used be nylon. It is also preferred that the material 50 be made of, or dyed, with bright colors, making it more eye catching.

The frame 15 on which the material is shaped is made out of nylon, wood, or any other sturdy, flexible material. Additional flexible material can be added to outside of the frame to complete the image of the animal or object being portrayed. The frame 15 extends around the periphery or circumference of the material. In a preferred embodiment of the invention, there are two projections 30 and 31 at the end 32 of the frame 15. These two projections 30 31, which are preferably positioned close to each other, fit into holes 33 and 34 found on the pivot doll 9. These two projections reside in the same vertical plane.

In a preferred embodiment of the invention, a rigid piece 22, perpendicular and attached to the doll, supports a hollow rod 70 which supports at least one, and preferably several, wind catching tail(s) 23. In a preferred embodiment, the hollow rod 70 slides over the rigid piece 22. The hollow rod 70 is kept in place by means of a cap 71 which fits over the end of the rigid piece 22. The hollow rod 70 preferably rotates freely about the rigid piece 22. This hollow rod 70 has two disk type structures 24 and 25 attached to the proximal and distal ends of the rigid piece. Along the edge or circumference 73 of these disks are holes 72.

The back section 20 serves to capture the wind and thus rotates the entire top structure 21. In order to do this, at least one vane 80, and preferably numerous vanes, in the form of tail-like structures, are affixed to the back section 20, preferably attached to the two disk type structures 24 and 25. The vain 80 comprises a piece of material 60, tightly stretched and supported by a frame 40. The piece of material can be in the shape of a tail, fin or any other identifiable form. The material 60 used can be nylon, silk, plastic, paper, cloth, or any other type of material which is flexible and durable. It is preferred that the material used be nylon. It is also preferred that the material be made of, or dyed, with bright colors, making it more eye catching.

The frame 40 on which the material is shaped is made out of nylon, wood, or any other sturdy, flexible material. Additional flexible material can be added to outside of the frame to complete the image of the animal or object being portrayed. The frame 40 extends around the periphery or circumference of the material. In a preferred embodiment of the invention, there are two projections 60 and 61 at the ends 62, 63 of the frame 40 of the vains 80. These two projections 60 and 61 fit into holes 72 around the circumference 73 of these disk type structures 24, 25. More specifically, one projection fits into the hole of one of disk type structures, and the other projection fits into the hole of one of the other disk type structures. In one embodiment of the invention, large headed grooves 90 are positioned in the disks, instead of holes, with the corresponding projection 91 having a bulbous end piece 92 to fit into the large headed grooves.

It should be noted that the holes or large headed grooves in the two disk type structures into which the two projections of the vains 80 do not have to be in alignment. Indeed, it may be preferable that the two projections 60, 61 at the ends 62, 63 of the frame 40 of the vains 80 not lie in the same plane with each other in relation to the plane of the hollow rod 70, thereby twisting the vane 80. This in turn allows the vain to catch the wind, and permits the hollow rod 70 about the rigid piece 22 to rotate and to direct the entire top structure 21.

In a preferred embodiment of the invention, the material 50 used to make up the fabric part of the structure is ripstop nylon, and the ground stake and extension piece is made out of fiberglass. It is also preferred that the front section have a main supporting rod 200 which makes up part of the frame structure. This gives the device strength, and durability. This supporting rod may be an integral part of the frame of the structure.

There may also be, in addition to the animal shaped structures, a pinwheel shaped device 100, wherein there are four wheels.

Many modifications and variations of the present invention are possible in light of the above teachings. It is, therefore, to be understood within the scope of the appended claims the invention may be protected otherwise than as specifically described.

What is claimed is:

1. A wind indicator toy, comprising:

a ground stake; and a top structure, said top structure comprising:

a pivot doll positioned on top of the ground stake, wherein the pivot doll can rotate atop the ground stake;

a front section, comprising a directional indicator, said directional indicator comprising a flat piece of material and a frame upon which the flat piece of material is tightly stretched;

a back section, said back section serving to capture the wind and rotate the entire top structure, said back section comprising at least one vane which serves to capture a wind which in turn rotates the entire top structure, said vane comprising a flat piece of material and a frame upon which the flat piece of material is tightly stretched:

a rigid piece, perpendicularly attached to said pivot doll;

a hollow rod which slides over the rigid piece and rotates freely about the rigid piece;

two disk type structures, one of said disk type structures being positioned at a proximal end of said hollow rod closest to said pivot doll, and the other of said disk type structures being positioned at a distal end of said hollow rod farthest away from said pivot doll, said disk type structures having a plurality of holes around the circumference of each said disk type structure;

and at least two projections extending from said frame of said at least one vane, wherein one of said at least two projection fits into one of said plurality of holes of one of said disk type structures, and the other of said at least two projections fits into one of said plurality of holes of the other said disk type structures.

2. The wind indicator toy according to claim 1, wherein said flat piece of material for said front section and said flat piece of material for said back section are selected from the group consisting of nylon, silk, plastic, paper and cloth.

3. The wind indicator toy according to claim 2, wherein said material is nylon.

4. The wind indicator toy according to claim 2, wherein said frame and said flat piece of material of said front section are shaped in the form of an animal.

5. The wind indicator toy according to claim 2, wherein said material is brightly colored.

6. The wind indicator toy according to claim 1, wherein said frame on which the material is stretched, is selected from the group consisting of nylon, wood and plastic.

7. The wind indicator toy according to claim 1, wherein said frame of said front section further comprises projections at an end of said frame, and said pivot doll further comprises holes into which said projections fit, thereby allowing for the attachment of the front section to the pivot doll.

8. The wind indicator toy of claim 7, wherein said front section further comprises a main supporting rod, attached to said pivot doll, providing support for the directional indicator.

9. The wind indicator of claim 8, wherein said main supporting rod is an integral part of the frame of the front section.

10. The wind indicator toy according to claim 1, wherein said back section further comprises:

a rigid piece, perpendicular and attached to said pivot doll;

a hollow rod which slides over the rigid piece and rotates freely about the rigid piece;

two disk type structures, one of said disk type structures being positioned at the proximal end of said hollow rod, and the other of said disk type structure being positioned at the distal end of said hollow rod, said disk type structures having large headed grooves around the circumference of each said disk type structure;

and projections having large headed fixtures extending from said frame of said at least one vane, wherein one projection fits into the large headed groove of one of said disk type structures, and the other said projection fits into the large headed groove of the other said disk type structures.

11. The wind indicator toy of claim 1, wherein said hole of one of said disk type structures into which one of said projections fits is out of alignment with the hole of the other said disk type structures into which the other of said projections fits, such that said holes do not lie in the same vertical plane, thereby giving the vane an angular bend.

12. A wind indicator toy, comprising:

a ground stake; and a top structure, said top structure comprising:

a pivot doll positioned on top of the ground stake, wherein the pivot doll can rotate atop the ground stake;

afront section, comprising a directional indicator, said directional indicator comprising a flat piece of material and a frame upon which the flat piece of material is tightly stretched;

a back section, said back section serving to capture the wind and rotate the entire top structure, said back section comprising at least one vane which serves to capture a wind which in turn rotates the entire top structure, said vane comprising a flat piece of material and a frame upon which the flat piece of material is tightly stretched;

a rigid piece, perpendicularly attached to said pivot doll;

a hollow rod which slides over the rigid piece and rotates freely about the rigid piece;

two disk type structures, one of said disk type structures being positioned at a proximal end of said hollow rod closest to said pivot doll, and the other of said disk type structures being positioned at a distal end of said hollow rod farthest away from said pivot doll, said disk type structures having a plurality of large headed grooves cut into the circumference of each said disk type structure;

and at least two projections having large headed fixtures extending from said frame of said at least one vane, wherein one projection of each said vane fits into the large headed groove of one of said disk type structures, and the other said projection of said at least two projections of each said vane fits into the large headed groove of the other said disk type structures.

13. The wind indicator toy of claim 12, wherein at least one of said large headed grooves of one of said disk type structures into which one of said projections fits is out of alignment with another of said large headed grooves of the other said disk type structures into which the other of said projections fits, such that said large headed grooves do not lie in the same vertical plane, thereby giving the vane an angular bend.

* * * * *